US006571540B1

(12) United States Patent
Imbert et al.

(10) Patent No.: US 6,571,540 B1
(45) Date of Patent: Jun. 3, 2003

(54) DEVICE FOR COMMUNICATING TWO CHAMBERS, WHILE MAINTAINING TIGHTNESS

(75) Inventors: Claude Imbert, La Tronche (FR); Jean-Yves Porret, Gieres (FR)

(73) Assignee: Becton Dickinson France S.A. (FR)

( * ) Notice: Subject to any disclaimer, the term of this patent is extended or adjusted under 35 U.S.C. 154(b) by 0 days.

(21) Appl. No.: 09/622,463

(22) PCT Filed: Apr. 1, 1999

(86) PCT No.: PCT/FR99/00769

§ 371 (c)(1),
(2), (4) Date: Oct. 23, 2000

(87) PCT Pub. No.: WO99/51348

PCT Pub. Date: Oct. 14, 1999

(30) Foreign Application Priority Data

Apr. 3, 1998 (FR) ..... 98 04407

(51) Int. Cl.[7] ..... B65B 31/00
(52) U.S. Cl. ..... 53/512
(58) Field of Search ..... 53/432, 434, 510, 53/512

(56) References Cited

U.S. PATENT DOCUMENTS 3,630,665 A * 12/1971 Andersen et al. ..... 422/33
4,308,710 A * 1/1982 Sandberg ..... 53/433
4,878,335 A * 11/1989 Hardy ..... 53/434
4,928,829 A * 5/1990 Di Bernardo ..... 206/524.8
5,322,101 A * 6/1994 Scherr et al. ..... 141/313
5,818,059 A * 10/1998 Coyne et al. ..... 250/507.1
6,155,027 A * 12/2000 Brooks ..... 53/434

* cited by examiner

*Primary Examiner*—Stephen F. Gerrity
*Assistant Examiner*—John Paradiso
(74) *Attorney, Agent, or Firm*—David M. Fortunato

(57) ABSTRACT

Device (10) for achieving communication, via a coupling means, between a first chamber (1) and a second chamber (2). The coupling means comprises, on the same side as the first chamber (1), a first shut-off member (41), and, on the same side as the second chamber (2), a second shut-off member (4) comprising a second flange (52) forming a seat for a second removable shutter element (72). The coupling means further comprises means of sealed connection between two flanges (51) and (52). The second chamber (2) being defined by the inside of a flexible and sealed bag (15), the border of the mouth of which is connected in a sealed way to the second flange (52). When the coupling, means is in an uncoupled position, the flexible bag (15) comprises a band (15*d*) extending the bag (15) continuously beyond the second flange (52), defining a closed (15*f*) and sealed, but openable envelope (12) for protecting the second shut-off member (42).

11 Claims, 2 Drawing Sheets

DEVICE FOR COMMUNICATING TWO CHAMBERS, WHILE MAINTAINING TIGHTNESS

BACKGROUND OF THE INVENTION

The present invention relates to a device for providing communication, via a coupling means, between a first chamber and a second chamber, each sealed with respect to an external medium, for example the atmospheric air, and having to remain sealed with respect to said medium, notwithstanding the fact that they are brought into communication. As a consequence, the device for ensuring communication, while operating reversibly, is designed also to preserve the seal, with respect to this same external medium, of the passage made between the two chambers.

For the purposes of the present description, and the interpretation of the appended claims, the expressions "seal" or "sealed" should be understood as meaning characteristics whereby any one wall separating two mediums prevents or restricts any transfer through said wall of one or more reference substances, for example so-called contaminants.

The expressions "contaminant" or "contamination" should be understood as meaning the characteristic whereby a substance has to remain excluded, or in a limited amount or concentration within a given medium. These are, for example, pathogens or pollutants, biological or otherwise, but also simple solid, liquid or gaseous particles which may be found in suspension in any fluid medium.

More specifically, but not exclusively, the present invention will be described hereinafter with reference to an application of the medical or biological type, requiring any contamination, including byparticles, originating from the external medium, to be avoided or limited. By way of example, as one, of the chambers is fixed, it consists for example of, a clean or sterile room, and the other chamber is removable, for example a use-once chamber, and contains one or more objects or a charge to be transferred, when the communication device is in the coupled position, through the passage thus made between the two chambers, namely from the removable chamber to the fixed chamber, for example to supply the latter with components or products required for the manufacture or production taking place in the clean room, or, conversely, to discharge waste or products from said room.

DESCRIPTION OF THE PRIOR ART

Various devices for allowing sealed communication between two chambers have already been proposed and are currently available on the market.

Thus, in accordance with document FR-A-2 721 289, to which reference is made as needed, such a device comprises:

- on the same side as a first chamber, a first shut-off member comprising a first flange forming a seat for a first removable shutter element, with a sealing gasket between the seat and the shutter;
- on the same side as a second chamber, a second shut-off member comprising a second flange forming a seat for a second removable shutter element, with a sealing gasket between the seat and the shutter;
- means of sealed connection between the two flanges, determining a peripheral and continuous external critical line liable to be contaminated, and means for the sealed connection of the two shutter elements, determining a peripheral and continuous internal critical line liable to be contaminated, and contiguous with the external critical line;
- one of the chambers being defined by the inside of a flexible and sealed bag, the border of the mouth of which is connected in a sealed way to the flange of the corresponding shut-off member.

As those skilled in the art well know, the expression "critical line" is understood to mean a line with residual contamination from the external medium at the two chambers which are brought into communication. During or following coupling, this line is liable to come into contact with the atmosphere or fluid present in the passage made between the two chambers, or into contact with the product or products passing through said passage, and to contaminate them.

SUMMARY OF THE INVENTION

For a device as defined earlier, the present invention sets out to limit the possible contamination by the critical line or lines, without resorting to decontamination thereof prior to coupling, and without making the coupling means used any more complicated either as regards its structure or as regards its operation.

In accordance with the present invention, when the coupling means is in the uncoupled position, the flexible bag comprises, at the opposite end to its closed end, a band extending it continuously beyond the flange of the corresponding shut-off member, determining a closed and sealed, but openable envelope for protecting most of the corresponding shut-off member and comprising an annular strip connected to said corresponding flange for separating the inside of the bag from the inside of the protective envelope in a sealed way.

The term "continuously" should be understood as meaning the characteristic whereby the wall of the flexible bag is continuous with respect to the sealing against the external medium required, between, on the one hand, the body of the bag, forming its main part, and on the other hand, the band forming the protective envelope. This continuity is obtained in various ways, namely either by continuity of material, or by a weld or sealed join between the body of the bag and the band.

Thanks to the invention, the component of the critical line or lines which lies on the same side as the shut-off member of the flexible bag, is fully protected by the protective envelope prior to coupling with the other shut-off member.

The solution according to the present invention also makes it possible to provide a better long-term seal of the chamber corresponding to the inside of the flexible bag, because the sealing of said bag with respect to the flange of the corresponding shut-off member is no longer involved in the sealing of said bag against the external medium; all of this is, of course, true if it is considered that the inside of the protective envelope and the inside of the bag are at the same pressures, for example under vacuum. From this point of view, the flexible bag with its additional band, as defined earlier is, from the functional view point, merely one and the same closed sheath, for example welded at both ends, namely on each side of the corresponding shut-off member. Thanks to the invention, it is the flexible bag, and the flexible bag alone, which as mentioned earlier is in the form of a closed sheath, which provides the seal both of the corresponding shut-off member and of the charge throughout the period of storage of the use-once assembly defined hereinabove.

The solution according to the invention also makes it possible to limit even further any possible contamination resulting from the handling of the use-once assembly combining or including the shut-off member, designed to be coupled to the other shut-off member (on the same side as the fixed chamber for example) and the flexible and sealed bag.

This is what happens:

after opening, the protective envelope can be withdrawn by hand, without the hands coming into contact with the front face of the shutter of the corresponding shut-off member;

and the protective envelope assures the user that the shut-off member and, in particular, its shutter, have remained uncontaminated prior to the opening of the envelope.

BRIEF DESCRIPTION OF THE DRAWING

The present invention is now described, by way of example, with reference to the appended drawing, in which.

Figure 1:
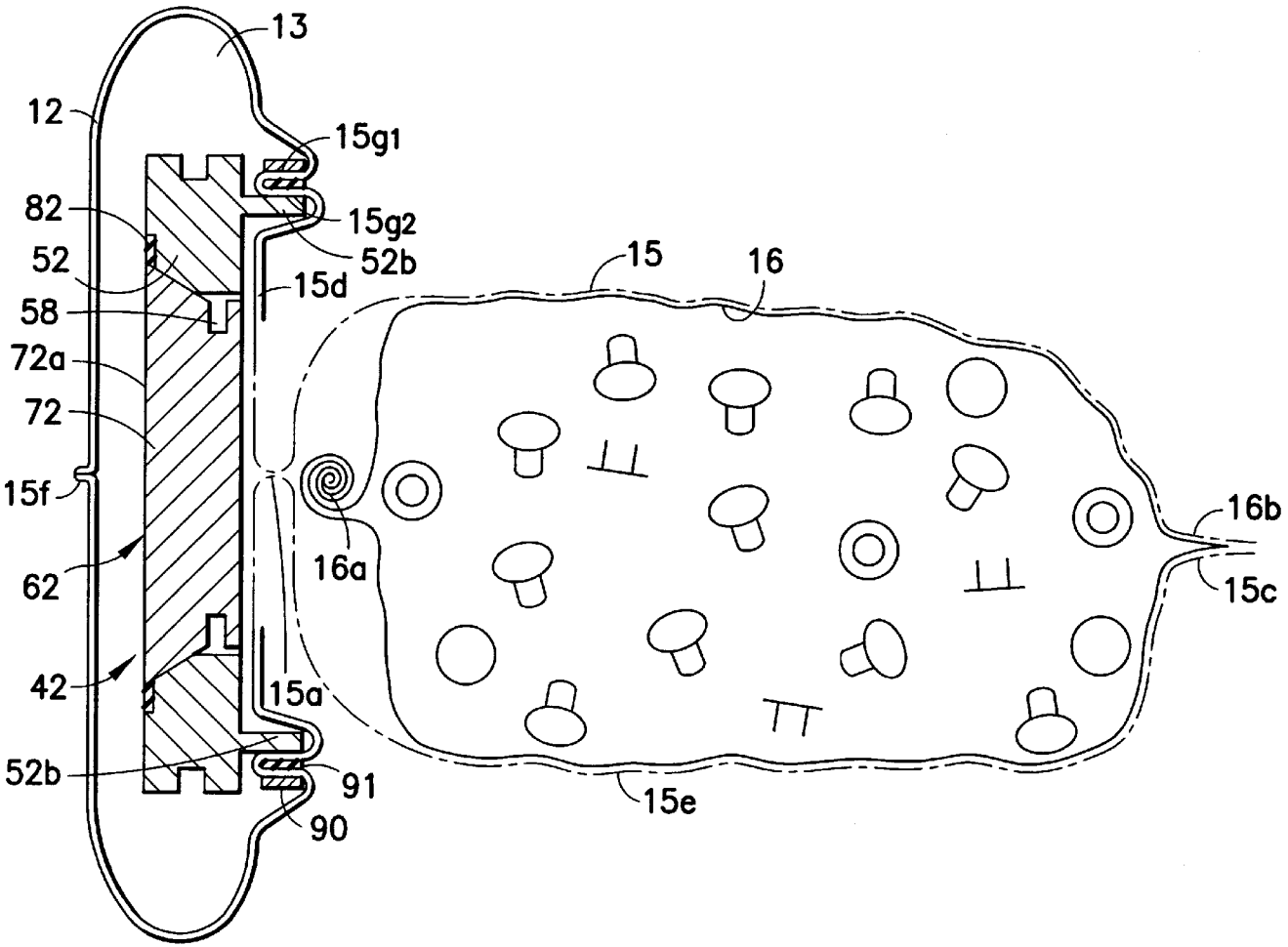
FIG. 1 depicts, viewed in section and diagrammatically, a use-once assembly in accordance with the invention, which has just been taken out of some outer packaging which was initially under vacuum.
Figure 2:
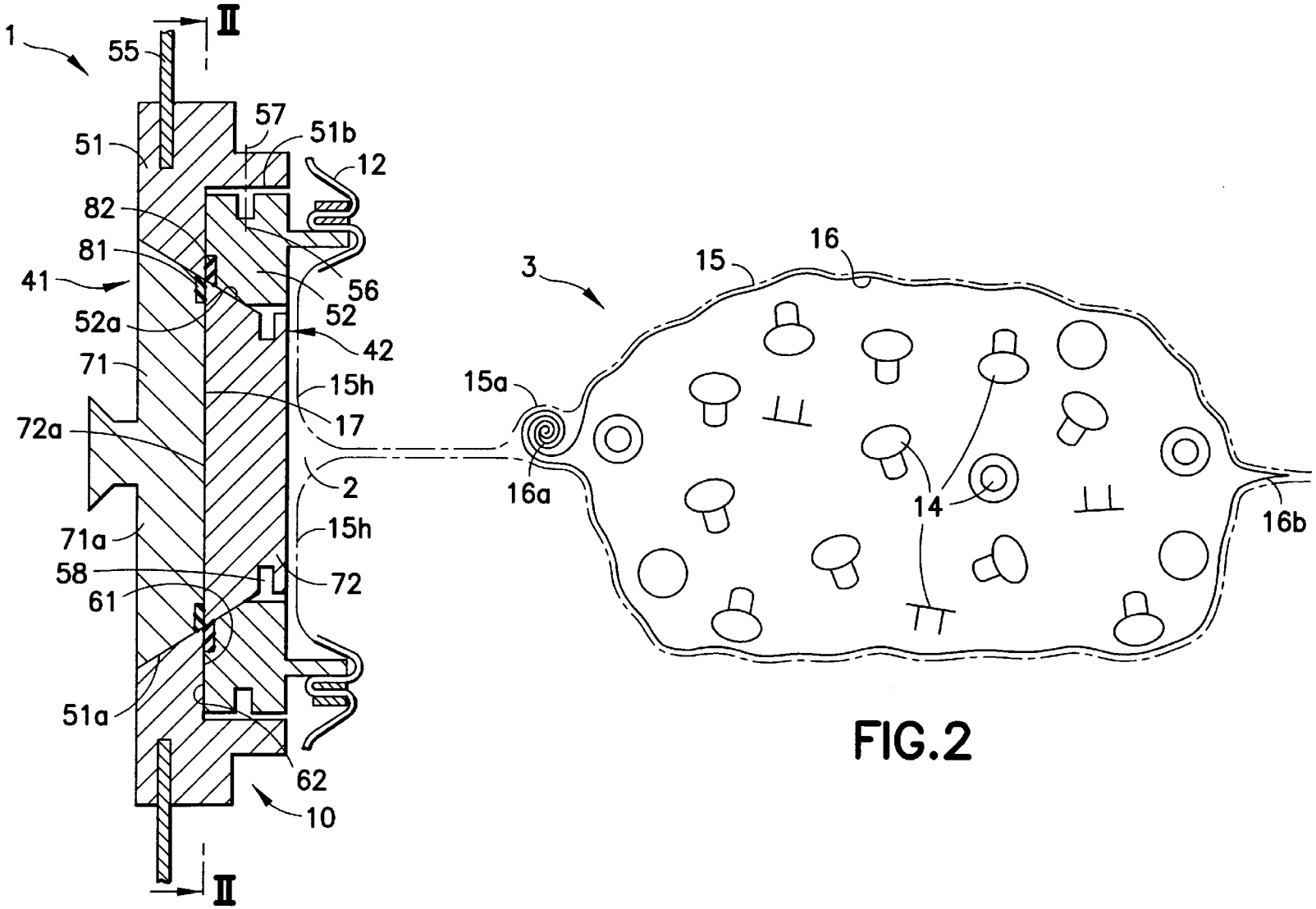
FIG. 2 depicts, still as a sectional view and diagrammatically, a device for providing communication in accordance with the invention, of which the assembly depicted in FIG. 1 forms a part; this device is depicted in its coupled position, prior to the inward opening of the shutter constituted by securely joining together the two shutter elements of the device according to the present invention.

In accordance with FIG. 2, a device 10 in accordance with the invention makes it possible to provide communication between:

a first chamber 1, consisting for example of a clean room, inside which there is some manufacture which requires a supply of components in loose form, these being identified, for example, by the reference 14 in FIG. 1, these in particular being rubber bungs; this first chamber is depicted by a partition 55 which is sealed against an external medium 3, consisting of an atmosphere, for example a normal and atmospheric atmosphere, it being understood that the first chamber is itself under a sterile or decontaminated atmosphere, at a slightly higher or lower pressure than the external medium 3; and a second chamber 2, defined by the inside of a flexible and sealed bag 15, for example under vacuum; the bag 15 belongs to a removable use-once assembly functionally combining a shut-off member 42 with said bag; the bag 15 comprises at least one object 14 or a charge to be transferred toward the chamber 1; this charge is itself sterile or decontaminated.

DESCRIPTION OF THE PREFERRED EMBODIMENTS

Functionally, and as the description hereinafter will show, a device 10 according to the invention makes it possible to establish communication between the chambers 1 and 2, preserving their seal against the external medium 3.

This device comprises:

on the same side as the fixed first chamber 1, a first shut-off member 41 itself comprising a first flange 51 forming a seat 51*a* for a first removable shutter element 71, with a sealing gasket 81 between the seat 51*a* and the removable element 71;

on the same side as the removable and use-once second chamber 2, a second shut-off member 42 comprising a second flange 52 forming a seat 52*a* for a second removable shutter element 72, with a sealing gasket 82 between the seat 52*a* and the removable element 72.

The shut-off members 41 and 42 are designed to be coupled together in a sealed but reversible way as follows:

the first shut-off member 41 forms a female part, via a bore 51*b* formed in the flange 51, and the second shut-off member 42 forms a male part, by the fitting of the flange 52 into the bore 51*b*; locking means 57, depicted in dotted line given the diversity of possible embodiments thereof, allow the second shut-off member 42 to be locked onto the first shut-off member 41;

securing means, not depicted, of the electromagnet or sucker type, allow the two shutter elements 71 and 72 to be secured together via their two front faces 71*a* and 72*a* which face each other; the first sealing gasket 81 also serves to provide a continuous peripheral seal between the two shutter elements 71 and 72, trapping in, in a sealed way, the contamination on their respective front faces;

the firm contact between the flanges 51 and 52, as shown in FIG. 2, is sealed by the second sealing gasket 82, and the two gaskets 81 and 82 are arranged adjacent to each other, in contact with each other via their inner and their outer lip Respectively As FIG. 2 shows, in the coupled position, on the one hand the seats 51*a* and 52*a* form, for example, one and the same frustoconical seat and, on the other hand, the shutter elements 71 and 72 form one and the same shutter with a frustoconical bearing surface, which means that said shutter can be handled as one piece by an operator stationed inside or outside the fixed chamber 1. Nonetheless, as means 58 are provided for locking together the shutter element 72 and the flange 52 of the second shut-off member 42, the operator will first of all have to make sure that the means 58 are unlocked.

If no special precautions are taken, the coupling of the shut-off members 41 and 42, then the opening of the shutter 71/72 bring about, within the passage between the chambers 1 and 2, two critical lines, one on the outside, on the same side as the flanges 51/52, corresponding to the lip of the second sealing gasket 82, and the other on the inside, on the same side as the shutter elements 71/72, corresponding to the lip of the first sealing gasket 81.

The solution according to the present invention makes it possible to minimize contamination by these critical lines.

According to the invention, and as depicted in particular in FIG. 1, in the uncoupled position of the communication device 10, the flexible bag 15 comprises, at the opposite end to its closed end 15*c*, a band 15*d* in a flattened configuration and folded on itself. This band 15*d* continuously extends the main,part 15*e* of the bag 15 beyond the flange 52 and in so doing determines an envelope 12 which is closed in a sealed way by a weld or a sealing means 15*f*, but which can be opened by the operator. This envelope protects most, if not all, of the corresponding shut-off member 42, that is to say the shut-off member of the flexible bag 15, described earlier. The band 15*d* comprises a strip 15*g* connected to the flange 52 and more specifically to a small collar 52*b* formed on the latter; for this purpose, the strip 15*g* is held tightly against the small collar 52*b* by a heat-shrunk or sweated-on or elastic, etc. outer clamping collar 90.

As FIG. 1 shows, the strip 15*g* is itself shaped into a fold, determining an outer flank 15*g*1 and an inner lank 15*g*2 trapping a flexible gasket or elastic material 91 between them. The connection between the strip 15*g* and the flange 52 makes it possible to separate the inside of the bag 15 from the inside of the protective envelope 12 in a sealed way.

Prior to coupling, on each side of the shut-off member 42, the inside of the protective envelope 12 and the inside of the bag 15 are under partial vacuum, for example, of the same-value. The protective envelope 12 can be opened prior to or at the moment of coupling of the two shut-off members 41 and 42.

As shown by FIGS. 1 and 2, the flexible bag 15 is an outer bag, and comprises or contains an inner flexible bag 16, possibly itself sealed, the wall of which may, for the most part, be common with or separate from the wall of the outer bag 15. It is in this inner bag 16 that the charge or object 14 to be transferred toward the fixed chamber 1 is to be found. The inner flexible bag 16 may or may not be connected, via its end 16*b* which is the opposite end to the end which has the shut-off member 42, to the closed end 15*c* of the outer flexible bag 15. As FIG. 1 shows, the inner flexible bag 16 comprises a sleeve 16*a* folded on itself and thus forming a means of closing the bag 16, it being understood that prior to coupling, and as depicted in FIG. 1, the outer flexible bag 15 and the inner flexible bag 16 are, for example, both under vacuum.

As shown in FIGS. 1 and 2, the band 15*d* of the flexible bag 15, under partial vacuum, has a relatively flattened shape connecting, on the one side, the actual mouth 15*a* of the bag 15 and determining, on the other side, a folded-over part 15*h* pressed against the rear face opposite it of the shut-off member 42. This layout yields two additional advantages:

after coupling, and prior to the opening of the shutter 71/72, the rear face (that is to say the face on the same side as the chamber 2) of said shutter is essentially exposed to the pressure of the external medium, across the folded-over region 15*h*; this limits the force to be exerted to open the shutter 71/72, bearing in mind the difference in pressure between the chambers 1 and 2;

this flattened shape constitutes a hinge or ball joint which furthermore allows most of the bag 15 to be oriented more easily with respect to the chamber 1, once the shutter 71/72 has been opened, for example in order to transfer the charge 14 under gravity.

What is claimed is:

1. A device (10) for achieving communication, via a coupling means, between a first chamber (1) and a second chamber (2), each of which is sealed with respect to an external medium (3), maintaining the seal against the external medium of a communication passage defined between the two chambers, said coupling means comprising:

on the same side as the first chamber (1), a first shut-off member (41) comprising a first flange (51) forming a seat for a first removable shutter element (71), with a sealing gasket (81) between the seat and the shutter;

on the same side as the second chamber (2), a second shut-off member (42) comprising a second flange (52) forming a seat for a second removable shutter element (72), with a sealing gasket (82) between the seat and the shutter;

means of sealed communication between the two flanges (51) and (52), defining a contaminable external critical line, and means for the sealed connection of the two shutter elements (71) and (72), defining a contaminable internal critical line, contiguous with the external critical line;

one (2) of the chambers being defined inside of a flexible and sealed bag (15) having a closed end (15*c*), the border of the mouth of which is, connected in a sealed way to the second flange (52);

wherein, when the coupling means is in the uncoupled position, the flexible bag (15) comprises, at the opposite end to its closed end (15*c*), a band (15*d*) extending it continuously beyond the corresponding flange (52), determining a closed (15*f*) and sealed, but openable envelope (12) for protecting most of the corresponding shut-off member (42) and comprising a strip (15*g*) connected to the corresponding flange (52) for separating the inside of the bag (15) from the inside of the protective envelope (12) in a sealed way.

2. The device as claimed in claim 1, wherein the strip (15*g*) of the flexible bag is held tightly against the corresponding flange (52) by a collar (90).

3. The device as claimed in claim 2, wherein the strip (15*g*) is shaped into a fold, determining an outer flank (15*g*1) and an inner flank (15*g*2) trapping a gasket (91) or flexible material between them.

4. The device as claimed in claim 1, wherein, on each side of the corresponding shut-off member (42), the inside of the protective envelope (12) and the inside of the bag (15) are under a partial vacuum.

5. The device as claimed in claim 1, wherein one (1) of the chambers is fixed, and the other chamber (2), defined by the inside, of the flexible bag (15) is removable to provide a use-once container.

6. The device as claimed in claim 5, wherein the flexible bag (15) comprises at least one object (14) or a charge to be transferred, when the coupling means is in the coupled position, through the communication passage from said removable chamber (2) to the fixed chamber (1).

7. The device as claimed in claim 6, wherein the flexible bag (15) is an outer bag and comprises a sealed inner flexible bag (16) separate from the outer bag (15), in which the charge or the object is placed.

8. The device as claimed in claim 7, wherein the inner flexible bag (16) is connected to the outer flexible bag (15) via its end (16*b*) which is the opposite end to the end which has the shut-off member (42).

9. The device as claimed in claim 7, wherein the inner flexible bag (16) comprises a sleeve (16*a*) forming a closure means by being folded on itself, and the outer flexible bag (15) is under partial vacuum.

10. The device as claimed in claim 9, wherein the inner flexible bag (16) is also under partial vacuum.

11. The device as claimed in claim 10, wherein the band (15*d*) of the flexible bag (15), has a relatively flattened shape and has a first end that connects the mouth (15*a*) of the bag, and a second end that defines a folded-over part (15*h*) pressed against the face opposite it of the second shut-off member (42).

* * * * *